United States Patent [19]

Tangorra

[11] Patent Number: 4,793,080

[45] Date of Patent: Dec. 27, 1988

[54] PERPETUAL CALENDAR

[76] Inventor: Frank Tangorra, Nassau Bay Branch, 18214 Upper Bay Rd., Nassau Bay, Tex. 77058

[21] Appl. No.: 926,321

[22] Filed: Nov. 3, 1986

[51] Int. Cl.[4] ..... G09D 3/02

[52] U.S. Cl. ..... 40/122; 40/107

[58] Field of Search ..... 40/120, 122, 107

[56] References Cited

U.S. PATENT DOCUMENTS

| | | | |
|---|---|---|---|
| 424,356 | 3/1890 | Romaine | 40/122 |
| 1,299,029 | 4/1919 | Reed | 40/122 |
| 3,142,920 | 8/1964 | Nelson et al. | 40/122 |

FOREIGN PATENT DOCUMENTS

| | | | |
|---|---|---|---|
| 292255 | 6/1928 | United Kingdom | 40/122 |

*Primary Examiner*—Gene Mancene
*Assistant Examiner*—J. Hakomaki

[57] ABSTRACT

A perpetual calendar that has a flat frame with two cavities. When cards are arranged in each cavity of the frame it will display a specific month. To display a particular number of days in a month, select the proper 31 day card and arrange the vertical slits on the card with the horizontal slit on the frame to obtain 28, 29, 30 or 31 days. To display a particular month choose the name of the month card to be viewed and insert it in the position of the frame provided for it. The few cards that are not used will remain in the frame cavities behind the month being displayed.

This perpetual calendar can also display three consecutive months at one time.

8 Claims, 6 Drawing Sheets

PERPETUAL CALENDAR

PERPETUAL CALENDAR

JANUARY
APRIL

JULY
OCTOBER

FEBRUARY
MAY

AUGUST
NOVEMBER

MARCH
JUNE

SEPTEMBER
DECEMBER

PERPETUAL CALENDAR

BACKGROUND OF PERPETUAL CALENDAR

This invention relates to an improved perpetual calendar construction that enables rapid reconfiguration by means of a few removeable cards with slits. When cards are inserted into a portion of the frame and arranged will display a specific month.

Previous perpetual calendars have been constructed with many parts and have a complicated procedure to reconfigure them. One perpetual calendar has construction with rollers which may be independently rotated to display the month, date and year. Another has individual blocks that are secured with magnetic tape. Most of these calendars have complicated construction with many parts, my perpetual calendar is simple in construction can be cheaply manufactured, has ten parts and can be rapidly reconfigured.

U.S. Pat. Nos. 554,833 February 1896, 684,107 October 1901, 1,109,814 September 1914, 1,427,850 September 1922, 2,892,277 June 1959, 4,176,478 December 1979 and 4,275,516 June 1981 disclose various types of calendars having moveable parts.

SUMMARY

I have devised a perpetual calendar that has a flat frame with two cavities, cards with 31 numbered days and cards with all months. This perpetual calendar can display a single month or three consecutive months.

To display a single month seven moving parts are made use of, when, three consecutive months are displayed ten moveable parts are used.

The number of days of each month is selected by displaying in the frame cavity the proper card.

By arranging a series of vertical slits on each of the cards numbered with 31 days and the horizontal slit provided on the frame a specific length of days can be selected.

The object of this invention is to eliminate buying a new calendar each year, simplifing prior art so changing to each month is rapid and simple, minimizing the number of parts used to achieve cheap fabrication and generating a calendar that closely resembles the everyday common calendar.

DESCRIPTION OF THE PREFERRED EMBODIMENTS

Figure 1:
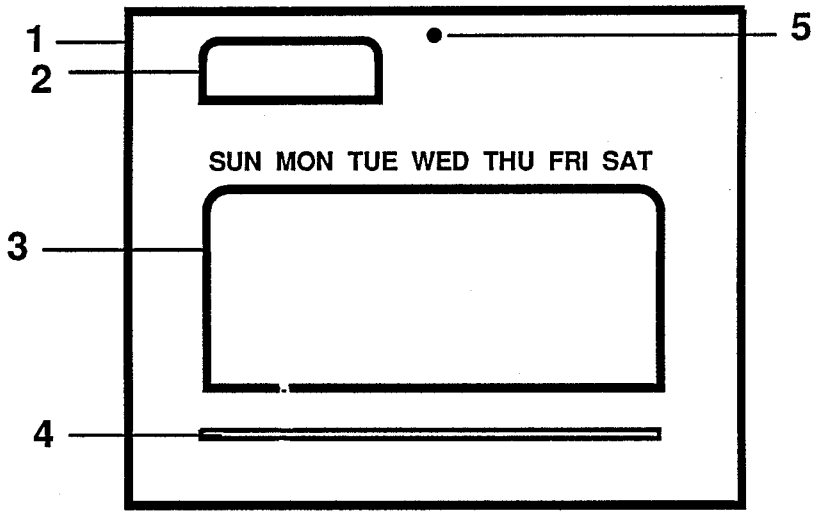
FIG. 1 is a front view of the front section of the frame.
Figure 2:
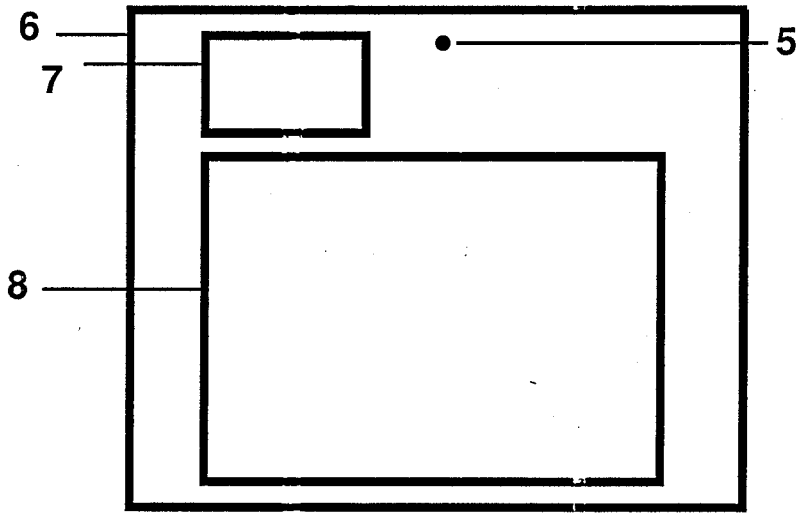
FIG. 2 is a front view of the middle section of the frame.
Figure 3:
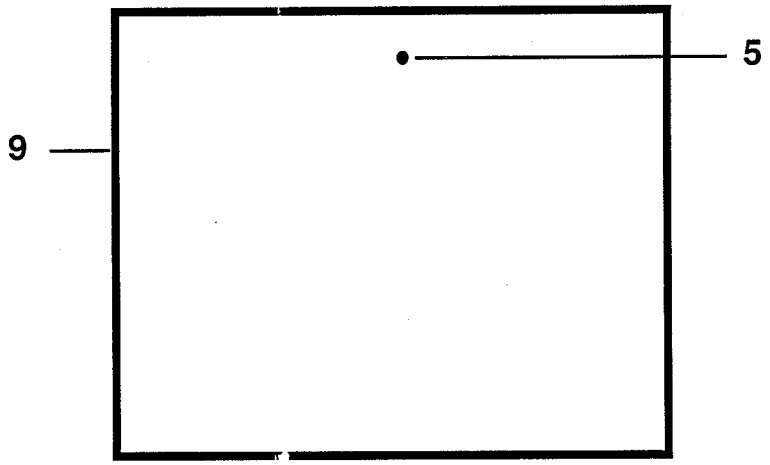
FIG. 3 is a front view of the back section of the frame.
Figure 4:
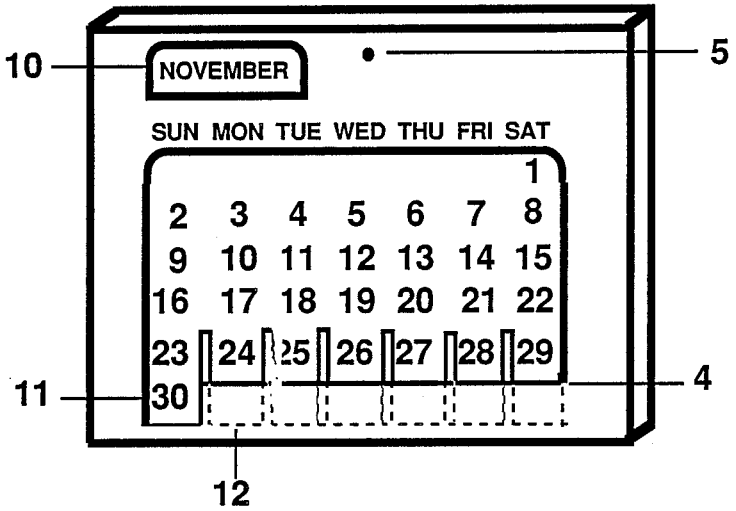
FIG. 4 is a view of the frame with FIGS. 1,2 and 3 assembled, and a month card and a days of the month card inserted in the frame.

Referring to FIGS. 1, 2 and 3 makes up the frame, FIG. 4. The front section 1, middle section 6 and back section 9 are fastened together and embodies the frame. Cutouts 2 and 3 on FIG. 1 serves to hold cards in place, slit 4 on the frame provides a means to select the length of month when arranged with vertical slits on cards. A means of hanging the calendar is shown at 5 on FIG. 4. Cutouts 7 and 8 on FIG. 2 serve to store and hold cards in place. Frame assembly FIG. 4 depicts a completed calendar with 10 displaying a selected month, 11 displaying a 30 day month tab visible, 12 indicating the 31 day tab concealed.

The frame, FIG. 4 provides tenancy for four days of month cards FIGS. 5*a*,5*b*,6*a*,6*b*,7*a*,7*b*,8*a*,8*b*,. Side a of each figure represents the front side of the card while b the back side of each card.

Tenancy is also provided in frame, FIG. 4 for the name of month cards FIGS. 9*a*,9*b*,10*a*,10*b*,11*a*,11*b*,.

Figure 5A:
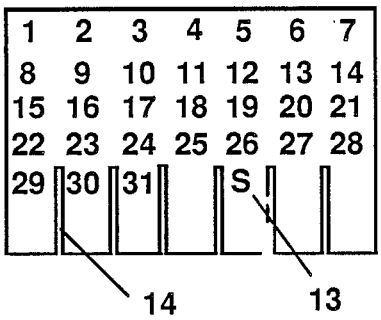
FIGS. 5*a* and 5*b* is the front and back of the first card with number of days.

Reference character 13 on FIG. 5*a* indicates the starting day of this card is S for Sunday, 14 on cards Figs. 5*a*,5*b*,6*a*,6*b*,7*a*,7*b*,8*a*, and 8*b* show the vertical slit necessary to obtain different day length per month. Reference character 15 on FIG. 5*b* indicates the starting day of this card is M for Monday, 16 on FIG. 6*a* indicates the starting day of this card is T for Tuesday, 17 on FIG. 6*b* indicates the starting day of this card is W for Wednesday, 18 on FIG. 7*a* indicates the starting day of this card is H for Thursday, 19 on FIG. 7*b* indicates the starting day of this card is F for Friday, 20 on FIG. 8*a* indicates the starting day of this card is A for Saturday, 21 on FIG. 8*b* indicates this card is blank.

To display a particular length of a month, insert the proper card S,M,T,W,H,F or A into the frame, arrange vertical slits with the horizontal slits on the frame to obtain 28,29,30 or 31 days.

To display a particular month choose the name of month card and insert it in the position of the frame provided for it.

Figures 9A, 9B, 10A, 10B, 11A, 11B, 12:
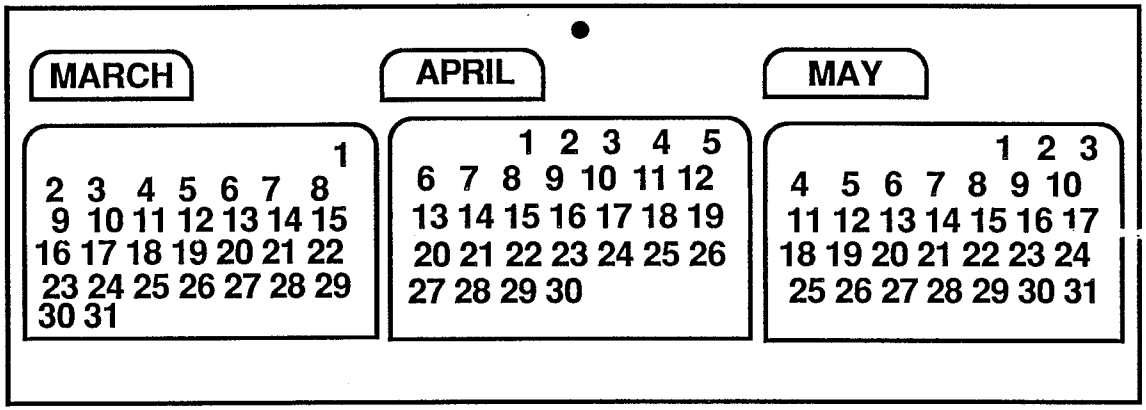
FIGS. 9*a* and 9*b* is the front and back of the first card with names of months.
FIGS. 10*a* and 10*b* is the front and back of the second card with names of months.
FIGS. 11*a* and 11*b* is the front and back of the third card with names of months.
FIG. 12 is a view of three consecutive months horizontally.

FIG. 12 Depicts the perpetual calendar displaying three months consecutively, horizontally.

Figure 13:
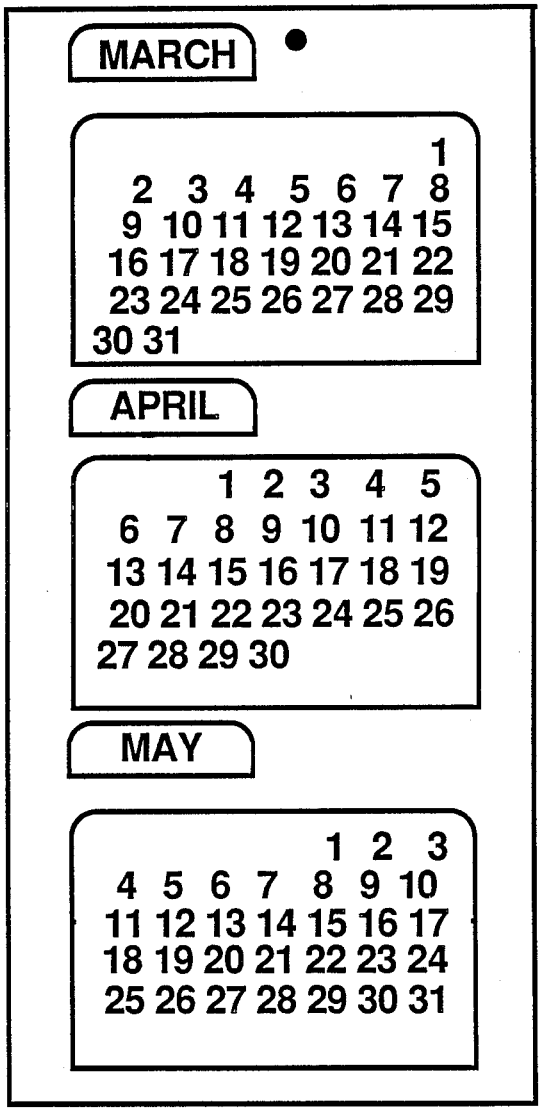
FIG. 13 is a view of three consecutive months vertically.

FIG. 13 Depicts the perperual calendar displaying three months consecutively, vertically.

Figure 5B:
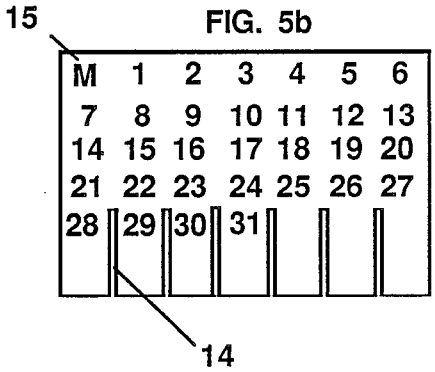
Figure 6A:
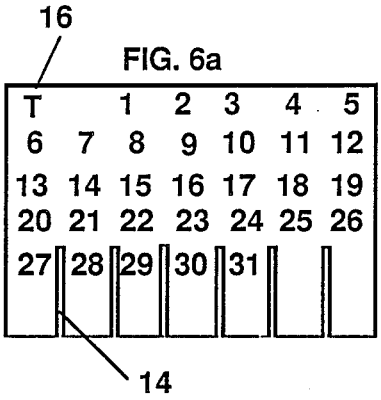
FIGS. 6*a* and 6*b* is the front and back of the second card with number of days.
Figure 6B:
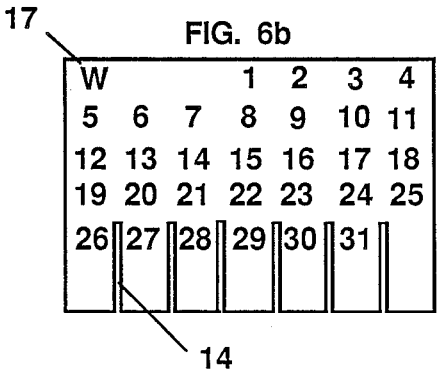
Figure 7A:
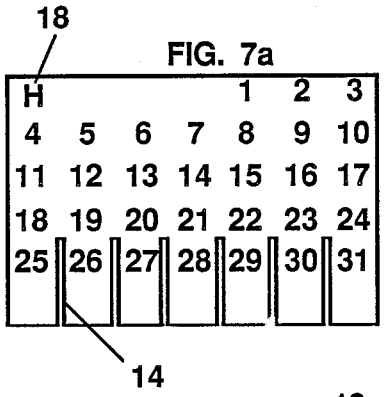
FIGS. 7*a* and 7*b* is the front and back of the third card with number of days.
Figure 7B:
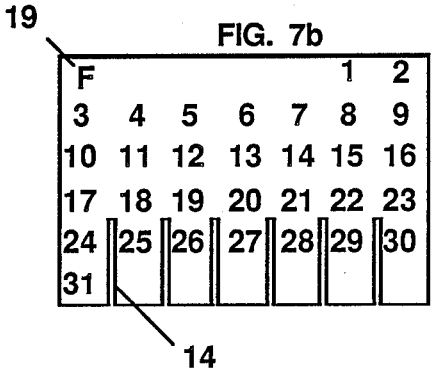
Figure 8A:
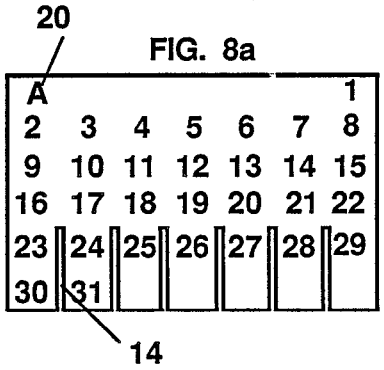
FIGS. 8*a* and 8*b* is the front and back of the fourth card with the number of days.
Figure 8B:
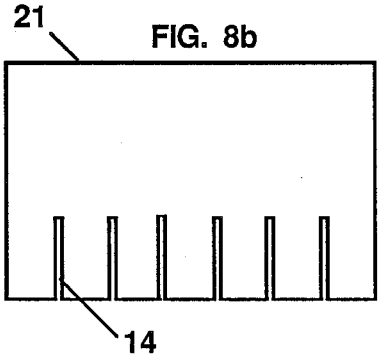

Fabrication of the three consecutive months requires seven day of months cards each card configured with front and back as follows: card 1, FIGS. 5*a*,5*b*, card 2, FIGS. 5*b*,6*a*, card 3, FIGS. 6*a*,6*b* card 4 FIGS. 6*b*,7*a*, card 5 FIGS. 7*a*,7*b* card 6 FIGS. 7*b*,8*a* card 7 FIGS. 8*a*,5*a*.

Preferred physical characteristics of a single calendar is approximate 9 inches by 12 inches overall, the cards and cavities should be proportionately sized according to FIG. 4. Material should consist of rigid cardboard approximately one eighth of an inch for FIG. 2 structure. All cards and other frame structures should be semi-rigid construction paper or plastic material approximately one sixty fourth of an inch. The structure of FIGS. 1,2 and 3 can be fastened together with a suitable glue or metal fasteners.

Printed instructions will be found on the back of the calendar for ready accessiblity to the user of the calendar.

Perpetual calendar directions:

1. Select the name of the month desired and insert it in the space provide.

2. For the year and month desired select a date card with S,M,T,W,H,F or A from the selection chart below.

SELECTION CHART

| | 1 | 2 | 3 | 4 | 5 | 6 | 7 | 8 | 9 | 10 | 11 | 12 |
|---|---|---|---|---|---|---|---|---|---|---|---|---|
| 1986 | W | A | A | T | H | S | T | F | M | W | A | M |
| 1987 | H | S | S | W | F | M | W | A | T | H | S | T |
| 1988 | F | M | T | F | S | W | F | M | H | A | T | H |
| 1989 | S | W | W | A | M | H | A | T | F | S | W | F |
| 1990 | M | H | H | S | T | F | S | W | A | M | H | A |
| 1991 | T | F | F | M | W | A | M | H | S | T | F | S |
| 1992 | W | A | S | W | F | M | W | A | T | H | S | T |
| 1993 | F | M | M | H | A | T | H | S | W | F | M | W |
| 1994 | A | T | T | F | S | W | F | M | H | A | T | H |
| 1995 | S | W | W | A | M | H | A | T | F | S | W | F |
| 1996 | M | H | F | T | W | M | A | H | S | T | F | S |
| 1997 | W | A | A | T | H | S | T | F | M | W | A | M |
| 1998 | H | S | S | W | F | M | W | A | T | H | S | T |
| 1999 | F | M | M | H | A | T | H | S | W | F | M | W |
| 2000 | A | T | W | A | M | H | A | T | F | S | W | F |

3. Insert date card selected so it can be viewed with the other cards behind it.

Directions to display every month there after.

(Once calander has been started.)

4. Do not remove existing date card(s) until you note the last day of the month.

5. Choose the next date card with the first day of the month, following the last day of the previous month.

6. If the month is April, June, September or November it will have 30 days, all the rest of the months have 31 days except February.

7. February has 28 days except for years: 1988, 1992, 1996, 2000, 2004, 2008, 2012, 2016. 2020, 2024, 2028, 2032, 2036, 2040, 2044, 2048, 2052, 2056, 2060, 2064, 2068, 2072, 2080, 2084, 2088, for which February is leap year and has 29 days.

I claim:

1. An improved perpetual calendar of the type having;

(a) cards with months;

(b) cards with numbers of days;

(c) a frame, wherein the improvement comprises of frontal separate cavities arranged and of size and shape to hold respective sets of cards snugly therein and configured with a horizontal slit to enable the concealment of a specific number or numbers on cards with number of days.

2. The improved perpetual calendar of claim 1, the improvement of said frame comprises of a front sheet having at least two windows in which cards with numbers are to be visible; a mid-section for retaining stacks of cards for insertion and removal; a backing sheet, having instructions thereon for selecting proper top cards to be displayed; and a means for securing said front sheet, mid-section and backing sheet together, said sheets may be one continous sheet.

3. The improved perpetual calendar of claim 1, the improvement of said frame comprises of days of the week inscribed thereon such that when a card with number of days is housed therein, each day of the week heads a different column of days of the month depicted on that card.

4. The improved perpetual calendar of claim 1, the improvement of said frame comprises of a means adapted to house cards snugly held in place, and are adjacently stacked such that the cards to be displayed are visible and repesents the selected month or date while the other cards remain concealed.

5. The improved perpetual calendar of claim 1, the improvement of the cards with numbers of days comprises of each card having slits extending from a common edge of the card beneath the last numbered row of days along respective lines beside the days in that row, and terminating above that row.

6. The improved perpetual calendar of claim 1, the improvement of cards with number of days comprises of a maximum of four moving parts achieving simplicity to reconfigure number of days with a familiar consistent array.

7. The improved perpetual calendar of claim 1, the improvement of the cards with months comprises solely of names of two different months inscribed on both sides of three cards.

8. the improved perpetual calendar of claim 1, the improvement enabling the displaying of any three consecutive months.

* * * * *